US008277268B2

(12) United States Patent
Misao

(10) Patent No.: US 8,277,268 B2
(45) Date of Patent: Oct. 2, 2012

(54) OUTDRIVE UNIT FOR BOATS

(75) Inventor: Hideo Misao, Amagasaki (JP)

(73) Assignee: Yanmar Co., Ltd., Osaka (JP)

( * ) Notice: Subject to any disclaimer, the term of this patent is extended or adjusted under 35 U.S.C. 154(b) by 165 days.

(21) Appl. No.: 12/844,994

(22) Filed: Jul. 28, 2010

(65) Prior Publication Data

US 2011/0033298 A1 Feb. 10, 2011

(30) Foreign Application Priority Data

Aug. 7, 2009 (JP) ..... 2009-184617

(51) Int. Cl.
*B63H 23/00* (2006.01)
*B63H 20/14* (2006.01)

(52) U.S. Cl. ..... 440/75

(58) Field of Classification Search ..... 440/75–78, 440/84, 86

See application file for complete search history.

(56) References Cited

U.S. PATENT DOCUMENTS

| | | | | |
|---|---|---|---|---|
| 4,946,409 | A * | 8/1990 | Suzuki | 440/75 |
| 5,328,396 | A * | 7/1994 | Hayasaka | 440/86 |
| 2003/0224671 | A1 | 12/2003 | Katayama et al. | |
| 2004/0192123 | A1 | 9/2004 | Mori et al. | |
| 2006/0073747 | A1 | 4/2006 | Harada et al. | |
| 2007/0289838 | A1 | 12/2007 | Misao | |
| 2008/0194158 | A1 | 8/2008 | Harada et al. | |

FOREIGN PATENT DOCUMENTS

| | | |
|---|---|---|
| EP | 1426287 A1 | 6/2004 |
| EP | 1645502 A2 | 4/2006 |
| EP | 1867566 A2 | 12/2007 |
| JP | Y2-S59-4879 | 2/1984 |
| JP | A-H11-182852 | 7/1999 |

OTHER PUBLICATIONS

European Search Report issued from the European Patent Office on Oct. 27, 2010 in the corresponding European patent application No. 10007862.5.

* cited by examiner

*Primary Examiner* — Daniel Venne
(74) *Attorney, Agent, or Firm* — Posz Law Group, PLC

(57) ABSTRACT

An object of the present invention is to provide an outdrive unit that allows space to be saved in the positioning of a hydraulic circuit for trolling, and enables easy maintenance of the hydraulic circuit for trolling. The invention provides an outdrive unit mounted outside of a boat, including: a propeller for propulsion; a hydraulic clutch that controls driving of the propeller; a transmission mechanism that transmits drive power from the hydraulic clutch to the propeller; a hydraulic circuit that operates the hydraulic clutch, the hydraulic circuit comprising a switching valve that switches a rotational direction of the propeller, a pressure-reducing valve for trolling that reduces a pressure of a pressurized oil supplied to the hydraulic clutch, a filter for the pressurized oil introduced to the pressure-reducing valve, and a hydraulic pump that supplies the pressurized oil to the hydraulic clutch; a housing that houses at least one of the hydraulic clutch, transmission mechanism, and hydraulic circuit; a base on which the switching valve, pressure-reducing valve, and filter are mounted, the base being detachably mounted in the housing.

9 Claims, 7 Drawing Sheets

OUTDRIVE UNIT FOR BOATS

FIELD OF THE INVENTION

The present invention relates to an outdrive unit mounted outside of a boat.

BACKGROUND

A sterndrive, which is one type of an inboard-outboard drive, is a main device comprising an engine and an outdrive unit. The engine is mounted inside the hull, and transmits driving power to the outdrive unit, which is mounted outside the hull. Recently, sterndrive units that allow trolling have also been developed as per user demands. Among such sterndrive units are, for example, those disclosed in Patent Literatures 1 and 2.

In the sterndrive unit disclosed in Patent Literature 1, a hydraulic clutch and a hydraulic circuit for operating the hydraulic clutch are located inboard. The hydraulic circuit also includes a switching valve for switching between forward and reverse propulsion, and a pressure-reducing valve for trolling. However, the hydraulic clutch and hydraulic circuit located inboard reduce the space available inside the boat. For this reason, Patent Literature 2 discloses locating a hydraulic clutch for trolling in an outdrive unit mounted outboard.

[PTL 1] Japanese Unexamined Patent Publication No. 1999-182582

[PTL 2] Japanese Examined Utility Model Publication No. 1984-4879

Because there is not a large amount of space that can be used inside an outdrive unit, it is necessary to save space in the positioning of a hydraulic circuit. Easy maintenance is also desired for an outdrive unit. However, in the device of Patent Literature 2, although the hydraulic clutch is located outboard, there is no specific disclosure of a hydraulic circuit for trolling control.

The present invention has been made in order to solve the above-described problem. An object of the invention is to provide an outdrive unit that allows space to be saved in the positioning of a hydraulic circuit for trolling, and that enables easy maintenance of the hydraulic circuit for trolling.

SUMMARY OF INVENTION

The invention provides an outdrive unit mounted outside of a boat, including a propeller for propulsion; a hydraulic clutch that controls driving of the propeller; a transmission mechanism that transmits drive power from the hydraulic clutch to the propeller; a hydraulic circuit that operates the hydraulic clutch; and a housing that houses at least one of the hydraulic clutch, transmission mechanism, and hydraulic circuit. The hydraulic circuit includes a switching valve that switches a rotational direction of the propeller; a pressure-reducing valve for trolling that reduces a pressure of a pressurized oil supplied to the hydraulic clutch; a filter for the pressurized oil introduced to the pressure-reducing valve; and a hydraulic pump that supplies the pressurized oil to the hydraulic clutch. The outdrive unit further includes a base on which the switching valve, pressure-reducing valve, and filter are mounted, the base being detachably mounted in the housing.

In this structure, the switching valve, pressure-reducing valve, and filter that constitute the hydraulic circuit are mounted all together on the base, thereby saving space. Moreover, because the hydraulic circuit for trolling control is located on the base, maintenance on trolling can be easily performed by detaching the base. Furthermore, cables necessary for controlling the switching valve and pressure-reducing valve can be drawn together from the base into the boat, enabling easy maintenance of the cables as well. Note that the shape of the base is not limited; the base may have a box shape that can house the switching valve and the like, or it may be made of a plate-like substrate.

The outdrive unit may further include a sensor that detects rotation of the transmission mechanism or hydraulic clutch. This enables detection of the trolling speed, such that trolling at a desired speed can be realized by controlling the pressure-reducing valve according to the detected rotation. The sensor can also be located on the base, further facilitating maintenance.

The outdrive unit may further include a power-generating device that is mounted on the base and that generates electrical power by the rotation of the transmission mechanism or hydraulic clutch; and a control device that is mounted on the base and that controls the switching valve and pressure-reducing valve. The control device can be operated with the electrical power generated by the power-generating device. Thus, power can be saved.

The control device can be operated wirelessly from inside the boat. This reduces the number of cables to be drawn from inside the boat. Of course, the control device can also be operated via cables from inside the boat.

In the outdrive unit, the base may be mounted on a stern side of the hydraulic clutch, and the hydraulic pump may also be mounted in the base. In this case, the hydraulic pump is connected to the clutch shaft of the hydraulic clutch, and is driven by the rotation of the clutch shaft.

In this structure, the hydraulic circuit that includes the hydraulic pump is mounted on the base, allowing the maintenance of the hydraulic circuit to be easily performed by detaching the base. Particularly because the base is mounted on the stern side of the hydraulic clutch, it can be easily detached. The base may be directly mounted to the hydraulic clutch, or may be mounted thereto via a fixing member. In the base, the switching valve and pressure-reducing valve may be located below the hydraulic pump. The hydraulic pump is located on the stern side of the hydraulic clutch, thereby saving space. The base may also be directly mounted on the stern side of the hydraulic clutch, or may be mounted to the hydraulic clutch via a partition or the like. When a partition or the like is used, the sensor may be secured to the partition.

Furthermore, a detachable cover may be provided on a stern side of the housing, allowing the base to be accessed by opening the cover. This provides quick access to the base by opening the cover, further facilitating maintenance. A plurality of such covers may also be provided. For example, a dual cover may be provided in order to prevent water ingress.

The outdrive unit according to the invention allows space to be saved in the positioning of a hydraulic circuit for trolling, and enables easy maintenance of the hydraulic circuit for trolling.

REFERENCE SIGNS LIST

Figure 1:
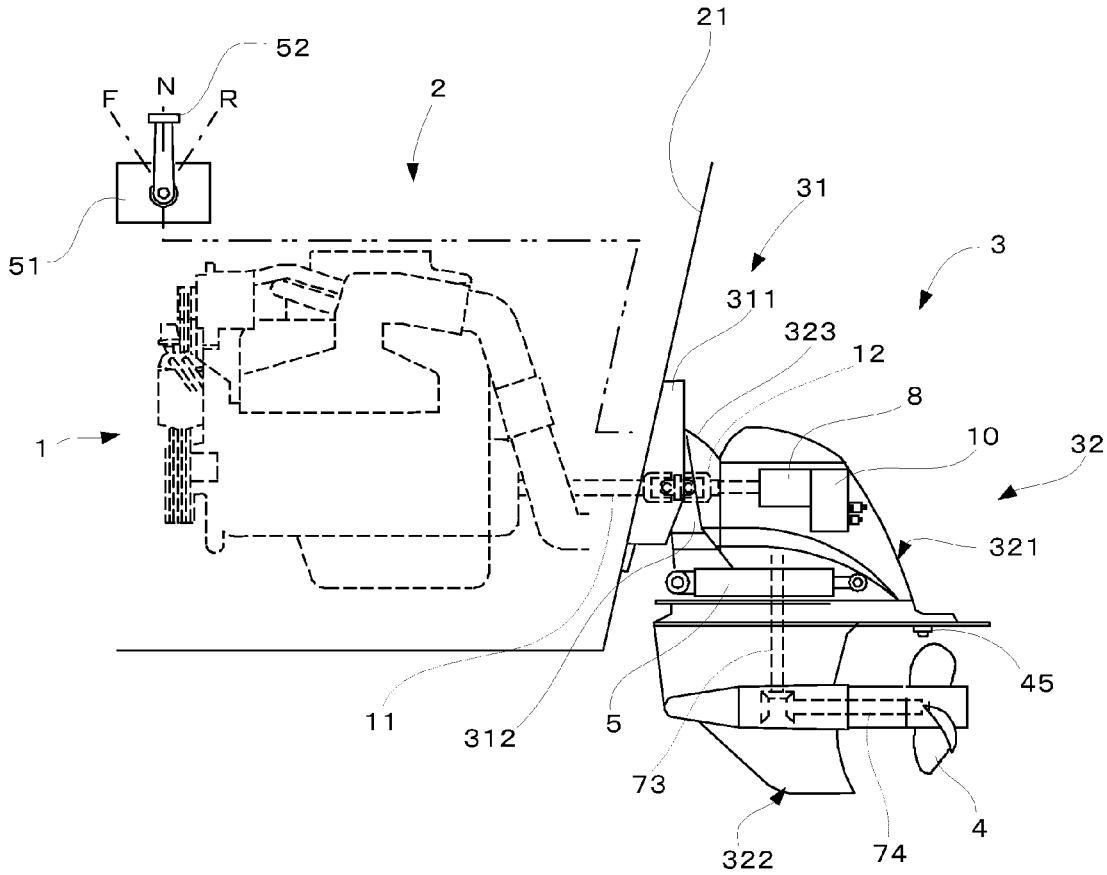
FIG. 1 is a cross section of a portion of an inboard-outboard drive according to an embodiment of the invention.

1: engine
3: outdrive unit
4: propeller
53: controller (control device)
54: power-generating device
8: hydraulic multiplate clutch (hydraulic clutch)
10: casing (base)
101: forward/reverse electromagnetic switching valve
102: electromagnetic proportional pressure-reducing valve
103: filter

DETAILED DESCRIPTION

Figure 2:
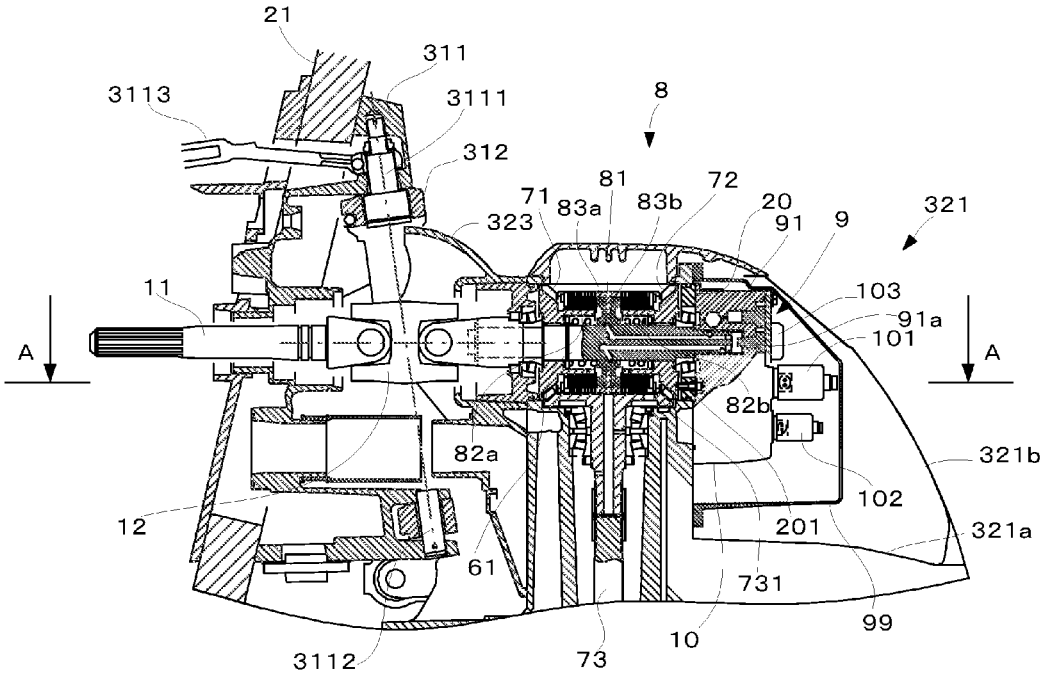
FIG. 2 is a cross section showing principal parts of the inboard-outboard drive of FIG. 1.
Figure 3:
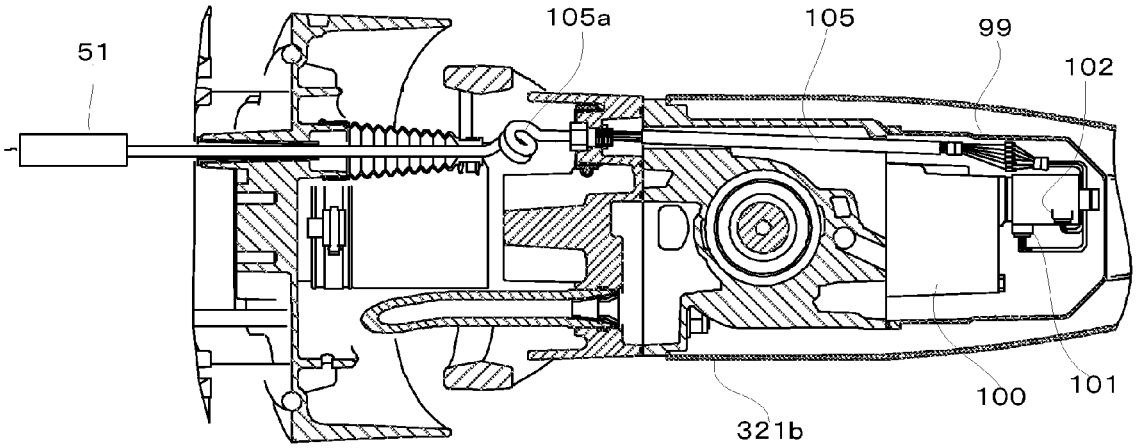
FIG. 3 is a cross section taken along line A-A in FIG. 2.
Figure 4:
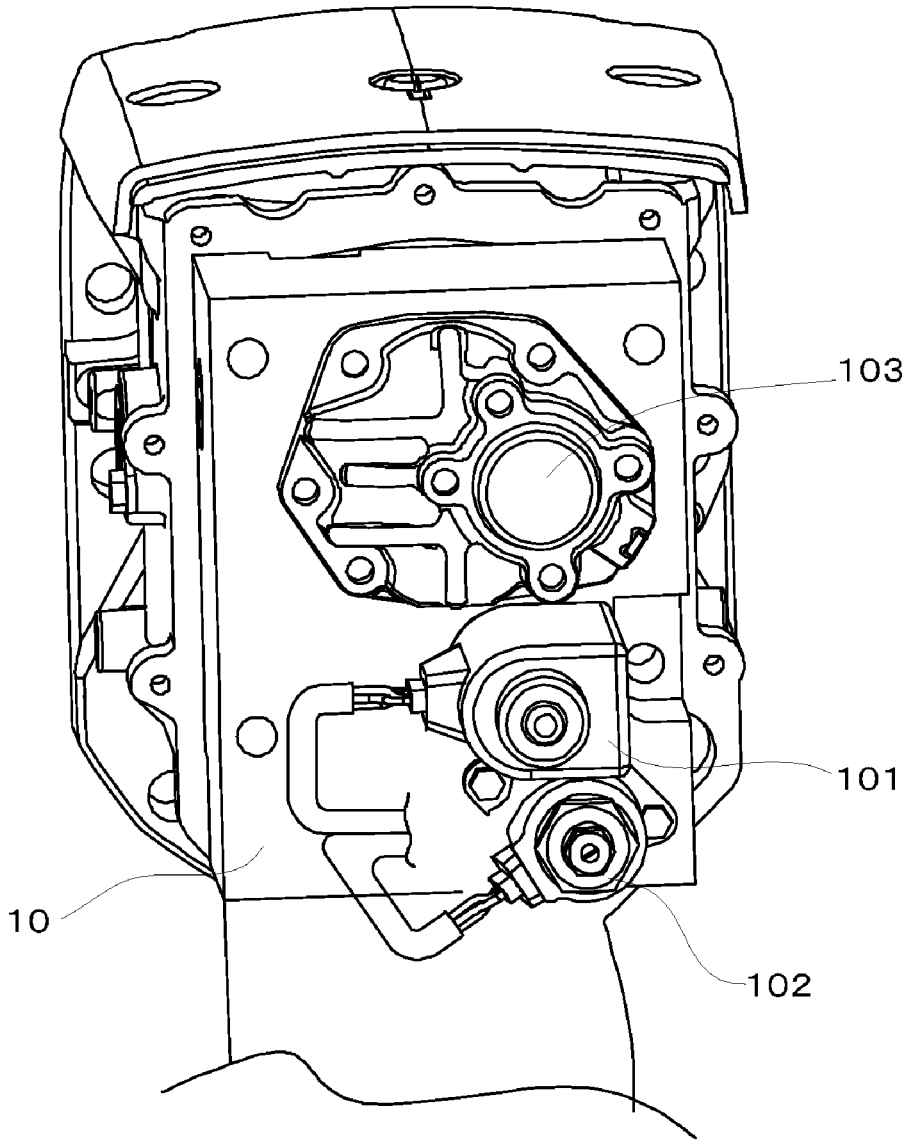
FIG. 4 is a perspective view showing the interior of an aft end of the outdrive unit of FIG. 2.

One embodiment of the outdrive unit according to the invention will be described below, referring to the drawings. A portion of a boat equipped with the outdrive unit is also described herein. FIG. 1 is a cross section of a portion of a sterndrive unit. FIG. 2 is a cross section showing principal parts of the inboard-outboard drive of FIG. 1. FIG. 3 is a cross section taken along line A-A in FIG. 2. FIG. 4 is a perspective view showing the interior of an aft end of the outdrive unit. In the specification, the bow side of the hull is referred to as "fore", and the stern side of the hull is referred to as "aft". The term "horizontal direction" means the direction from the starboard side to the port side, or vice versa.

As shown in FIGS. 1 and 2, the inboard-outboard drive installed in a boat includes an engine 1 and an outdrive unit. The engine 1 is mounted inside a hull 2, and the outdrive unit 3 is mounted outside the hull 2. The outdrive unit 3 is a propulsion device incorporating propeller blades 4, a clutch, and the like, and is connected to a transom portion 21 at the stern. Further, as will be described below, power from the engine 1 is transmitted to the outdrive unit 3 via an input shaft 11 that extends outboard, thereby driving the propeller blades 4.

The outdrive unit is now described in further detail. The outdrive unit 3 includes a body portion 31 connected to the transom portion 21, and a housing 32 pivotally connected to an aft end of the body portion 31. As shown in FIG. 2, the body portion 31 includes a gimbal housing 311 secured to the transom portion 21; and a gimbal ring 312 supported by pivot shafts 3111 and 3112 at lower and upper portions, respectively, of the gimbal housing 311. The gimbal housing 311 houses the input shaft 11 of the outdrive unit 3. The gimbal ring 312 is capable of pivoting in the horizontal direction via the pivot shafts 3111, 3112. A steering lever 3113 that extends inside the hull is connected to the upper pivot shaft 3111.

The housing 32 includes an upper housing 321 and a lower housing 322 that are arranged in the vertical direction. Further, a bell housing 323, which is inserted through an opening in the gimbal ring 312, is connected to a fore end of the upper housing 321. Both side surfaces of the gimbal ring 312 are connected to trim-shaft members (illustration omitted) disposed on both sides of the bell housing 323, whereby the bell housing 323 can pivot about the gimbal ring 312 in the vertical direction. The pivoting is performed by a pair of hydraulic cylinders 5 disposed on both sides of the housing 32. Each hydraulic cylinder 5 has a fore end attached to the gimbal ring 312, and an aft end attached to the upper housing 321. Thus, during travel, extending the hydraulic cylinders 5 causes the housing 32 to pivot upward, i.e., trimming out, and retracting the hydraulic cylinders 5 causes the housing 32 to pivot downward, i.e., trimming in.

As shown in FIG. 2, the upper housing 321 has an upper housing body 321*a* that houses a forward gear 71, a reverse gear 72, a hydraulic multiplate clutch 8, and the like; and a cosmetic cover 321*b* that covers side surfaces and a portion of an upper surface of the upper housing body 321*a*. The input shaft 11 of the outdrive unit is connected to a clutch shaft 61 via a universal joint 12 (see FIG. 1). The input shaft 11, universal joint 12 and clutch shaft 61 in turn extend into the upper housing 321 via the interiors of the gimbal housing 311 and bell housing 323. The clutch shaft 61 is then connected to the clutch 8 in the upper housing 321. The forward gear 71 and reverse gear 72 are pivotally fitted into fore and aft sides, respectively, of the clutch shaft 61, with the clutch 8 disposed between the fore and aft sides of the clutch shaft 61. By actuating the clutch 8, either of the gears 71, 72 is connected to the clutch shaft 61.

As shown in FIG. 2, the forward gear 71 and reverse gear 72 are engaged with a bevel gear 731, which is secured to the upper end of a drive shaft 73 that extends vertically. A bevel gear (illustration omitted) is also secured to a lower end of the drive shaft 73. A propeller shaft 74 that extends in the fore-aft direction can be rotated via this bevel gear. As shown in FIG. 1, the propeller blades 4 are attached around an outer peripheral surface of the propeller shaft 74. The gears 71, 72, drive shaft 73, bevel gear 731, and the like that transmit power to the propeller blades 4 from the clutch constitute the transmission mechanism of the invention.

A hydraulic control unit 9 incorporating a hydraulic pump 91, a hydraulic circuit for controlling a clutch hydraulic oil, and the like is mounted to a stern-side end of the clutch shaft 61. The hydraulic control unit 9 has a casing 10, in which the hydraulic pump 91 is located. The hydraulic pump 91 is a gear pump with a pair of gears. A gear 91*a*, which is one of the gears constituting the gear pump, is engaged with the end of the clutch shaft 61 and rotates with the clutch shaft 61, whereby oil is pumped from an oil sump described below so that the hydraulic oil is supplied to the clutch 8. A trochoid pump, for example, may be used as the hydraulic pump 91. Furthermore, as shown in FIG. 4, an aft end of the casing (base) 10 is provided with a forward/reverse electromagnetic switching valve 101, electromagnetic proportional pressure-reducing valve 102, a pressure-reducing valve filter 103, and a relief valve 104 (see FIG. 5), which constitute a hydraulic circuit. More specifically, the pressure-reducing valve filter 103, forward/reverse electromagnetic switching valve 101, and electromagnetic proportional pressure-reducing valve 102 are arranged in order from top to bottom. An oil passage that connects these components is also located in the casing 10. As shown in FIGS. 2 and 3, the hydraulic control unit 9 is further covered with an interior cover 99 located inside the cosmetic cover 321*b*. This prevents water ingress. The interior cover 99 also prevents oil from leaking outside from the hydraulic control unit 9. Further, a partition 20 is located on a fore end of the casing 10. The partition 20 is provided with a sensor 201 that detects rotation of the forward gear 71 or reverse gear 72.

As shown in FIG. 3, a single bundle of cables 105, which are connected to the forward/reverse electromagnetic switching valve 101, electromagnetic proportional pressure-reducing valve 102, sensor 201, and the like, passes along an interior side surface of the housing 32, and is connected to an inboard controller 51. Midway along this wiring is formed a portion 105*a* that extends in the form of a spiral. When the cables 105 are pulled during trimming in or out of the housing 32, the spiral portion 105*a* is unwound and extended. The cables 105 include, for example, leads for supplying electrical power, in addition to signal cables for transmitting signals to the switching valve and the like.

As shown in FIG. 2, the hydraulic multiplate clutch 8 includes an outer drum 81 that is secured to the clutch shaft 61; and inner drums 82*a*, 82*b* that are disposed radially inward of the outer drum 81, and extend from the forward gear 71 and reverse gear 72, respectively. A plurality of forward annular pressure plates and reverse annular pressure plates are attached to an inner surface of the outer drum 81 so that they can move in the fore-aft direction. A plurality of forward annular clutch plates and reverse annular clutch plates are also attached to the inner drums 82*a*, 82*b*, respectively, so that they can move in the fore-aft direction. The clutch 8 is also provided with a forward piston 83*a* and reverse piston 83*b* that press the forward and reverse pressure plates, respectively, via the hydraulic oil from the hydraulic pump.

Further, an oil sump is formed fore of the propeller shaft 74 in the lower housing 322. The oil contained in the oil sump is pumped through the hydraulic pump 91, and used as a hydraulic oil and lubricating oil for the clutch 8. The oil supplied to the clutch 8 as a lubricating oil drops down through gaps in the periphery of the bevel gear 731 located on the upper end of the drive shaft, and through the oil passage located around the periphery of the drive shaft 73, and then returns to the oil sump.

Figure 5:
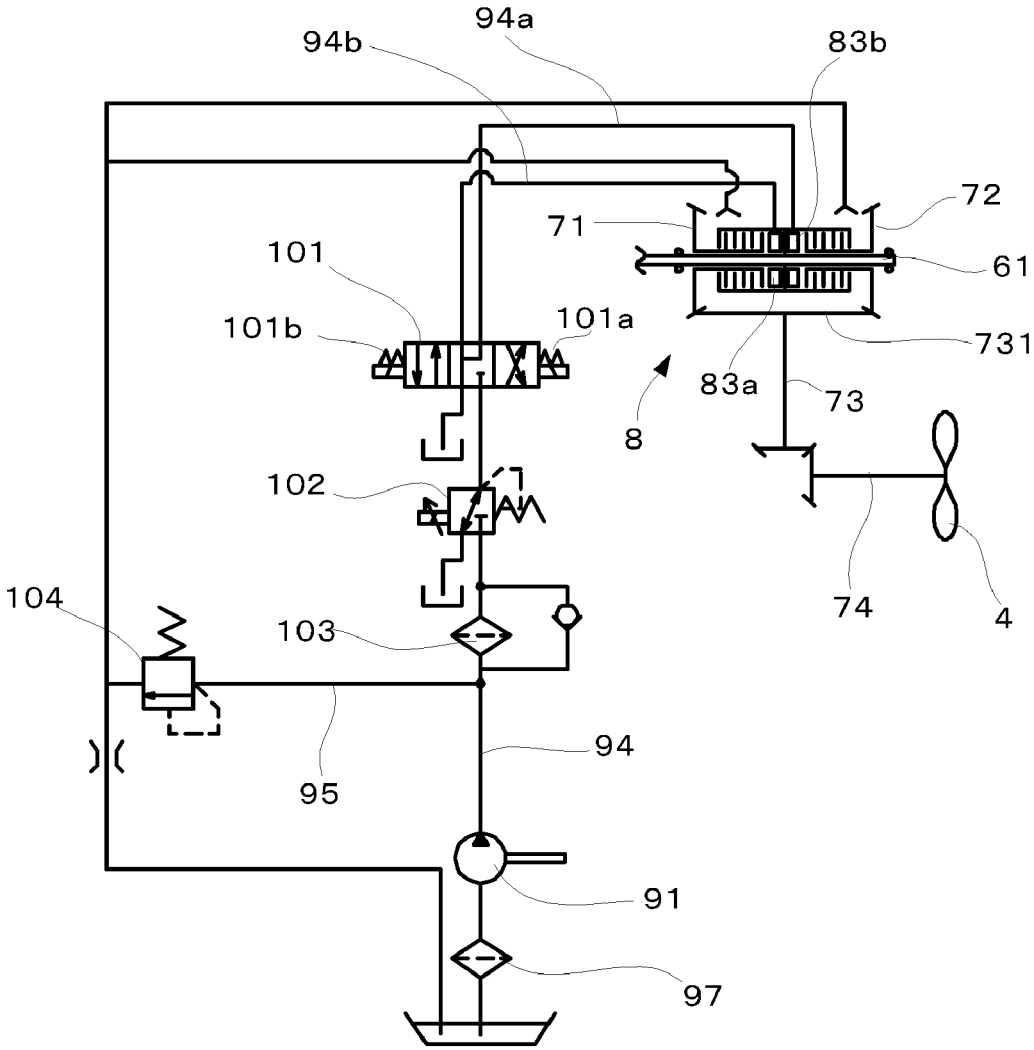
FIG. 5 is a hydraulic circuit diagram of the outdrive unit according to an embodiment of the invention.

The hydraulic circuit of the outdrive unit is described next. FIG. 5 is a hydraulic circuit diagram. Pressurized oil pumped by the hydraulic pump 91 from the oil sump via a filter 97 passes through a hydraulic oil supply passage 94 and is supplied to the clutch 8. The filter 103, electromagnetic proportional pressure-reducing valve 102, and forward/reverse electromagnetic switching valve 101 are disposed in order from the hydraulic pump 91 along the hydraulic oil supply passage 94. The controller 51 shown in FIG. 1 is provided with a shift lever 52. By operating the shift lever 52, the forward/reverse electromagnetic switching valve 101 is actuated, causing the oil passage for supplying the hydraulic oil from the oil sump to be switched to a forward oil passage 94*b* or reverse oil passage 94*a*, which is connected to the forward piston 83*a* or reverse piston 83*b*, respectively, of the clutch 8. The controller 51 is also provided with a trolling control unit not shown in FIG. 1. The trolling control unit opens/closes the electromagnetic proportional pressure-reducing valve 102. Specifically, by adjusting the opening/closing of the electromagnetic proportional pressure-reducing valve 102, the pressure plates and clutch plates in the clutch 8 are caused to slip against one another to attain a so-called half-clutch position, thereby enabling trolling. Moreover, by instantaneously attaining a half-clutch position by adjusting the opening/closing of the electromagnetic proportional pressure-reducing valve 102, shock caused by sudden engagement of the clutch 8 can be reduced. The hydraulic circuit is also provided with a relief valve 104. The relief valve 104 is disposed along a branch oil passage 95, which branches from the hydraulic oil supply passage 94 between the hydraulic pump 91 and filter 103. The branch oil passage 95, which branches off partway from the hydraulic oil supply passage 94, is connected to the clutch 8. When the relief valve 104 is opened by a pressure exceeding a prescribed pressure, the pressurized oil is supplied to the clutch 8 as a lubricating oil.

When electrical current is not applied to the forward/reverse electromagnetic switching valve 101, return springs 101*a*, 101*b* cause the forward/reverse electromagnetic switching valve 101 to shift to a position for stopping the oil supply to the clutch 8. In the event that electrical current cannot be applied to the forward/reverse electromagnetic switching valve 101 because of electrical problems such as a disconnection, the return springs 101*a*, 101*b* cause the hydraulic oil supply to be discharged via a drain, so that the clutch 8 is disengaged, and the boat stops.

The operation of the outdrive unit with the above-described structure is described next. As stated above, when the shift lever 52 is placed in a forward position F, hydraulic oil is supplied to the forward piston 83*a* of the clutch 8 via the forward/reverse electromagnetic switching valve 101, causing the clutch shaft 61 and forward gear 71 to be connected. This causes power from the input shaft 11 to be transmitted to the drive shaft 73 via the forward gear 71, causing the propeller blades 4 to rotate in the forward direction. Conversely, when the shift lever 52 is placed in a reverse position R, hydraulic oil is supplied to the reverse piston 83*b* of the clutch 8 via the forward/reverse electromagnetic switching valve 101, causing the clutch shaft 61 and reverse gear 72 to be connected. This causes the reverse gear 72 to be rotated, causing the propeller blades 4 to rotate in the reverse direction. Furthermore, a half-clutch position can be attained by adjusting the electromagnetic proportional pressure-reducing valve 102 using the controller 51, thereby enabling trolling. During trolling, the number of revolutions of the propeller blades 4 is detected by a sensor 201 provided in the casing. The degree of opening/closing of the electromagnetic proportional pressure-reducing valve 102 is then adjusted to a number of revolutions that is suitable for trolling.

As described above, according to this embodiment, the forward/reverse electromagnetic switching valve 101, electromagnetic proportional pressure-reducing valve 102, and filter 103 are mounted on the casing 10. This allows maintenance to be easily performed by detaching the casing 10. Particularly because the casing 10 is located at the aftermost position of the housing 32, it is readily accessible by detaching the cosmetic cover 321*b* and interior cover 99. This further facilitates maintenance. Moreover, because the hydraulic circuit for trolling control is located on the casing 10, maintenance on trolling can be performed all together by detaching the casing 10.

While one embodiment of the present invention has been described above, the invention is by no means limited to the foregoing embodiment, and various modifications are possible without departing from the gist of the invention. For example, although the controller 51 is located inboard in the foregoing embodiment, it may also be located in the outdrive unit.

Figure 6:
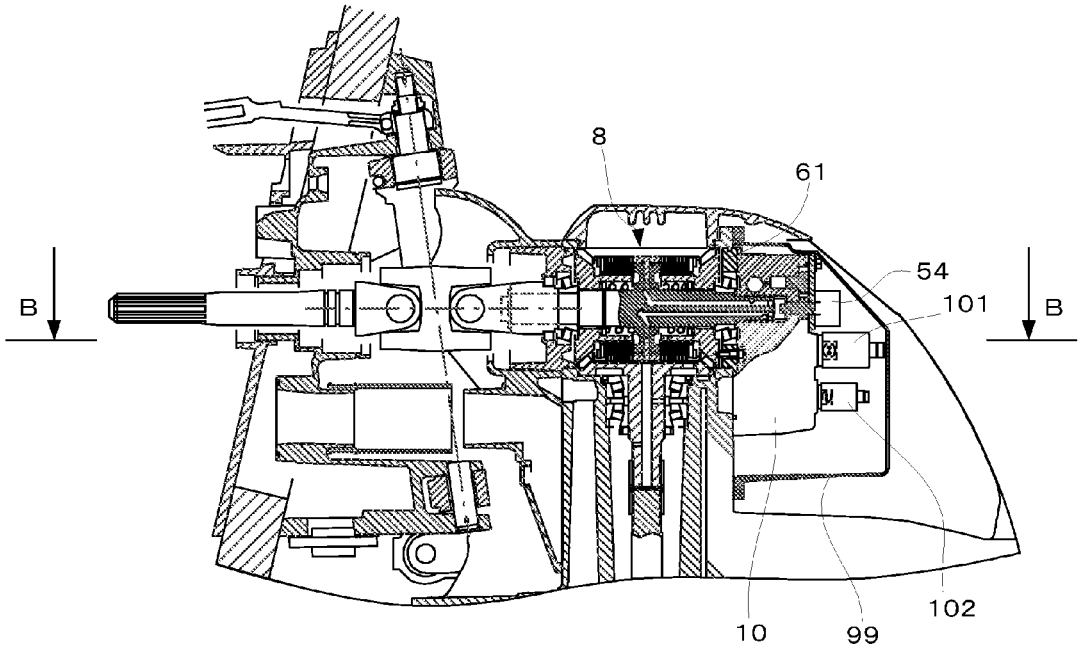
FIG. 6 is a cross section showing another embodiment of the outdrive unit of FIG. 2.
Figure 7:
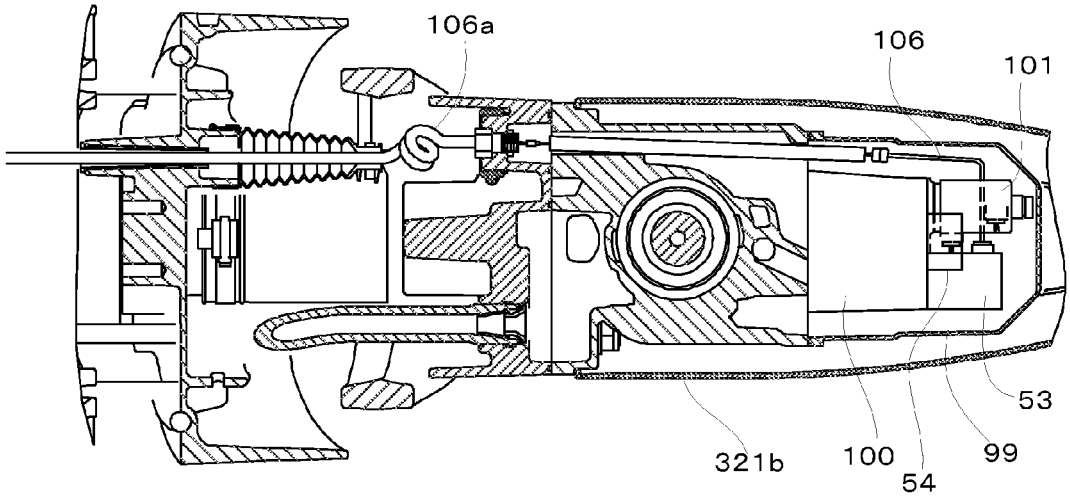
FIG. 7 is a cross section taken along line B-B in FIG. 6.

FIG. 6 is a cross section of an outdrive unit, and FIG. 7 is a cross section taken along line B-B in FIG. 6. In the embodiment shown in FIGS. 6 and 7, a casing 10 for a hydraulic control unit 9 further houses a controller 53 and a power-generating device 54. The power-generating device 54 is connected to an aft end of a clutch shaft 61, and generates electrical power by rotation of the clutch shaft 61. An electromagnetic switching valve 101 and the like are operated with the generated electrical power, under the control of the controller 53. Moreover, in this embodiment, the controller 53 is equipped with a wireless device, allowing the controller 53 to be operated based on a radio signal transmitted from inside the boat. A single cable 106, which extends inboard from the controller 53, is used to allow communication between the controller 53 and inboard devices such as the engine. The use of such a wireless device is not limited to the use in an outdrive unit that allows trolling. Note that when the controller 53 is operated via cables, cables for transmitting signals are further required.

Furthermore, in the foregoing embodiment, the number of revolutions of the propeller blades 4 is controlled by detecting the rotation of the forward or reverse gear using the sensor 201; however, for example, as shown in FIG. 1, a pressure sensor 45 may be located on a lower end of the upper housing 321 in a position opposite the propeller blades 4, thereby detecting the number of revolutions of the propeller blades 4. The sensor may also be located in a desired position on either the clutch 8 or on the transmission mechanism.

Furthermore, because the hydraulic circuit associated with trolling, which contains the pressure-reducing valve 102 and the like, is located all together in the casing 10, an outdrive unit that does not have a trolling function can be easily made capable of trolling by mounting the casing 10 thereto.

The invention claimed is:

1. An outdrive unit mounted outside of a boat, comprising:
a propeller for propulsion;
a hydraulic clutch that controls driving of the propeller;
a transmission mechanism that transmits drive power from the hydraulic clutch to the propeller;
a hydraulic circuit that operates the hydraulic clutch, the hydraulic circuit comprising a switching valve that switches a rotational direction of the propeller, a pressure-reducing valve for trolling that reduces a pressure of a pressurized oil supplied to the hydraulic clutch, a filter for the pressurized oil introduced to the pressure-reducing valve, and a hydraulic pump that supplies the pressurized oil to the hydraulic clutch;
a housing that houses at least one of the hydraulic clutch, transmission mechanism, and hydraulic circuit;
a base on which the switching valve, pressure-reducing valve, and filter are mounted, the base being detachably mounted in the housing; and
a sensor that is mounted on the base and detects rotation of the transmission mechanism or hydraulic clutch.

2. The outdrive unit according to claim 1, further comprising:
a power-generating device that is mounted on the base and generates electrical power by rotation of the transmission mechanism or hydraulic clutch; and
a control device that is mounted on the base and controls the switching valve and pressure-reducing valve, the control device being operated with the electrical power generated by the power-generating device.

3. The outdrive unit according to claim 2, wherein the control device is operated wirelessly from inside the boat.

4. The outdrive unit according to claim 1, wherein:
the base is mounted on a stern side of the hydraulic clutch, and the hydraulic pump is also mounted in the base; and
the hydraulic pump is connected to the clutch shaft of the hydraulic clutch and is driven by rotation of the clutch shaft.

5. The outdrive unit according to claim 4, wherein a detachable cover is provided on a stern side of the housing, allowing the base to be accessed by opening the cover.

6. An outdrive unit mounted outside of a boat, comprising:
a propeller for propulsion;
a hydraulic clutch that controls driving of the propeller;
a transmission mechanism that transmits drive power from the hydraulic clutch to the propeller;
a hydraulic circuit that operates the hydraulic clutch, the hydraulic circuit comprising a switching valve that switches a rotational direction of the propeller, a pressure-reducing valve for trolling that reduces a pressure of a pressurized oil supplied to the hydraulic clutch, a filter for the pressurized oil introduced to the pressure-reducing valve, and a hydraulic pump that supplies the pressurized oil to the hydraulic clutch;
a housing that houses at least one of the hydraulic clutch, transmission mechanism, and hydraulic circuit;
a base on which the switching valve, pressure-reducing valve, and filter are mounted, the base being detachably mounted in the housing;
a power-generating device that is mounted on the base and generates electrical power by rotation of the transmission mechanism or hydraulic clutch; and
a control device that is mounted on the base and controls the switching valve and pressure-reducing valve, the control device being operated with the electrical power generated by the power-generating device.

7. The outdrive unit according to claim 6, wherein the control device is operated wirelessly from inside the boat.

8. The outdrive unit according to claim 6, wherein:
the base is mounted on a stern side of the hydraulic clutch, and the hydraulic pump is also mounted in the base; and
the hydraulic pump is connected to the clutch shaft of the hydraulic clutch and is driven by rotation of the clutch shaft.

9. The outdrive unit according to claim 8, wherein a detachable cover is provided on a stern side of the housing, allowing the base to be accessed by opening the cover.

* * * * *